US005275619A

United States Patent [19]

Engebretson et al.

[11] Patent Number: 5,275,619

[45] Date of Patent: Jan. 4, 1994

[54] LOW BIRTH WEIGHT INFANT PACIFIER

[75] Inventors: Joan Engebretson; Diane Wardell; Victoria Brownewell, all of Houston, Tex.

[73] Assignee: Board of Regents, The University of Texas System, Austin, Tex.

[21] Appl. No.: 637,259

[22] Filed: Jan. 3, 1991

[51] Int. Cl.[5] ..... A61J 17/00

[52] U.S. Cl. ..... 606/236; 606/234; D24/194

[58] Field of Search ..... 606/234–; 215/11.1–; D24/194–

[56] References Cited

U.S. PATENT DOCUMENTS

| | | | |
|---|---|---|---|
| 577,199 | 2/1897 | Neidlinger | 215/11.1 |
| 2,600,978 | 6/1952 | Demarco . | |
| 2,661,001 | 12/1953 | Alstadt et al. | 215/11.5 |
| 2,812,764 | 11/1957 | Crisp . | |
| 2,825,335 | 3/1958 | Natonek | 606/236 |
| 3,126,116 | 3/1964 | Clinehens | 215/11.1 |
| 3,669,112 | 6/1972 | Mager et al. . | |
| 3,825,014 | 7/1974 | Wroten . | |
| 3,968,690 | 7/1976 | Blouin et al. . | |
| 4,321,927 | 3/1982 | Lynch . | |
| 4,688,571 | 8/1987 | Tesler . | |
| 4,715,379 | 12/1987 | McCormick | 606/234 |
| 4,909,253 | 3/1990 | Cook et al. . | |
| 5,078,733 | 1/1992 | Eveleigh et al. | 606/236 |

FOREIGN PATENT DOCUMENTS

| | | | |
|---|---|---|---|
| 0530266 | 8/1957 | Belgium | 606/234 |
| 2055451 | 5/1971 | Fed. Rep. of Germany | 606/235 |
| 2656819 | 6/1977 | Fed. Rep. of Germany | 606/234 |
| 379508 | 1/1986 | Fed. Rep. of Germany . | |
| 0903008 | 9/1945 | France | 606/236 |
| 1120990 | 7/1956 | France . | |
| 0561251 | 4/1957 | Italy | 606/236 |
| 0411234 | 11/1966 | Switzerland | 215/11.1 |
| 2192549 | 1/1988 | United Kingdom | 606/234 |
| 8603403 | 6/1986 | World Int. Prop. O. | 606/236 |
| 8606273 | 11/1986 | World Int. Prop. O. . | |

*Primary Examiner*—Stephen C. Pellegrino
*Assistant Examiner*—Glenn K. Dawson
*Attorney, Agent, or Firm*—Arnold, White & Durkee

[57] ABSTRACT

A pacifier for use with premature and other low birth weight infants, which is configured dependent upon the shape of a small infant's thumb and palatal cavity. The pacifier has a shield and a nipple. The nipple is longer and thinner than previously known pacifiers, and comprises a relatively soft, narrow shaft connecting a bulbous tip to the shield. The tip is configured to provide optimal palatal stimulation while the infant sucks on the pacifier, while the shield is shaped to simultaneously provide optimal perioral stimulation.

5 Claims, 2 Drawing Sheets

LOW BIRTH WEIGHT INFANT PACIFIER

BACKGROUND OF THE INVENTION

1. Field of the Invention

This invention relates to a pacifier and nipple designed for use with premature and other low-birth-weight infants.

2. Background

It is known that supplemental non-nutritive sucking, in addition to that required for feeding, can help to soothe an infant. Researchers have discovered that there is a clear reflex connection between the hand and mouth of a human fetus as early as 12–14 weeks after conception, and that thumb sucking in utero is common. After birth, many infants continue to soothe themselves by sucking on their thumbs or fingers. A newborn's ability to get his hands up to his mouth and suck is seen as a positive ability of the infant to organize himself in a self-soothing way. This helps establish the infant's ability to independently cope with stress and frustration. In order to provide the pacifying effects of this type of oral stimulation, commercial pacifiers have been used for years by many grateful parents and health care personnel caring for infants. Developmental effects of early thumb sucking are hypothesized, but very little is known about them.

To take advantage of the soothing effect that sucking has on an infant, pacifiers of various shapes and sizes have been developed. None, however, is known which adequately meets the needs of the premature or low-birth-weight ("LBW", below 5000 grams) infant. These infants, which can weigh as little as 1000 grams or less, have particular need for a suitable pacifier, because they often have difficulty getting thumb to mouth due to their underdevelopment in light of the premature loss of the buoyant assistance received from the amniotic fluid in utero.

There is a need for an effective pacifier designed for LBW and very-low-birth-weight infants. Prior pacifiers are generally very large compared to a LBW infant's mouth, and most which are targeted for premature or newborn babies are merely scaled down versions of the larger pacifiers, with no features designed to meet the special needs of LBW babies.

One commercially available pacifier which is known to be advertised as designed specifically for premature infants is distributed by DHD Medical Products and appears to be constructed in accordance with U.S. Pat. No. 4,715,379. The nipple design of the DHD pacifier is generally similar to that shown in FIG. 5 of the cited patent and is depicted in FIG. 4A of this patent. While the DHD nipple is smaller than most currently available alternatives, it has proven difficult to use in practice, and it does not provide the palatal stimulation of the invention disclosed herein.

There are other pacifiers on the market which are designed or advertised for use with newborns or premature infants. None of these prior art pacifiers, however, employ the unique features of this invention. No prior art is known which embodies or discloses a pacifier designed to replicate the palatal stimulation which an infant receives by sucking its thumb, and which is sized based on measurements taken of the thumbs of LBW infants.

SUMMARY OF THE INVENTION

The invention claimed and disclosed herein is a pacifier with a nipple that is designed to simulate the palatal stimulation that a baby receives from sucking its thumb. It is based on measurements of the thumbs and palatal cavities of LBW infants. Based on molds made of the thumb and palate of a LBW infant, it was discovered that the thumb fits almost perfectly into the palatal arch. The nipple of the pacifier of this invention is dimensioned to take advantage of that relationship, and to provide a pacifier which replicates the palatal stimulation provided by the infant's thumb in utero. The result is a nipple which is longer and thinner than any known in the prior art, comprising a narrow, soft and flexible shaft leading to a bulbous and somewhat firmer tip. The length and circumference of the nipple are selected to simulate the average thumb size of the intended users of the pacifier and the shaft is designed to place the tip into the proper position in the infant's palatal arch during use.

Clinical trials of prototypes of this invention have been very encouraging. Infants accepted the prototype more quickly, sucked it more vigorously, and fell asleep more quickly as compared to prior art pacifiers commonly in use in hospital nurseries. The prototype was particularly effective for very small infants, for whom no good alternative for non-nutritive sucking currently exists.

BRIEF DESCRIPTION OF THE DRAWINGS

So that the manner in which the herein described advantages and features of the present invention, as well as others which will become apparent, are attained and can be understood in detail, more particular description of the invention summarized above may be had by reference to the embodiment thereof which is illustrated in the appended drawings, which drawings form a part of this specification.

It is to be noted, however, that the appended drawings illustrate only exemplary embodiments of the invention and are therefore not to be considered limiting of its scope, for the invention may admit to other equally effective embodiments.

DESCRIPTION OF THE PREFERRED EMBODIMENT

Figure 1:
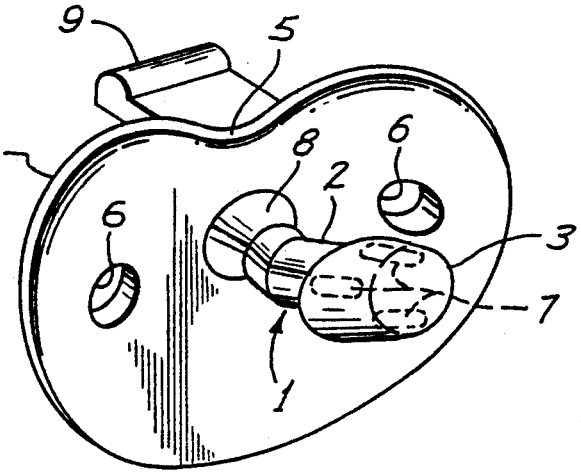
FIG. 1 is a perspective view of a pacifier constructed in accordance with the present invention.

FIG. 1 illustrates the present invention, showing the unique nipple design which is attached to the shield. Nipple 1 comprises shaft portion 2 and tip portion 3. Narrow, tubular shaft portion 2 connects bulbous tip portion 3 to shield portion 4. In the preferred embodiment the entire pacifier is constructed of one piece of an elastomer, such as, for example, silicone or natural or synthetic rubber, or a blend of these. It can be constructed by any suitable forming process, including, but not limited to, dip molding, injection molding, compression molding and transfer molding. Alternatively, a nipple constructed in accordance with this invention may be incorporated into a pacifier consisting of two or more pieces, including a separate shield or handle piece.

Shield portion 4 covers a portion of the infant's face between its nose and chin, and includes indentation 5 along its top margin to avoid blocking the nose. Shield portion 4 is generally curved to conform to the infant's face, and is provided with two holes 6 to permit air circulation under the shield, to prevent chapping of the skin of the face, and to allow ventilation as a safety feature.

A study has been conducted to determine the dimensions of the human thumb in premature infants and to determine whether the growth of the thumb is proportionally related to growth of the oral cavity. Thumb length was measured from the lower edge of the proximal metacarpal to the distal edge of the thumb. Thumb circumference was taken at the widest portion of the thumb, located at the distal metacarpal. Based on a sample of 49 LBW infants, all between 29 and 41 weeks gestation, the thumb length ranged from 17 millimeters to 26 millimeters with the mean of 21 millimeters and the thumb circumference ranged from 20 millimeters to 28 millimeters with a mean of 24 millimeters. This measured circumference of premature infant's thumbs was substantially smaller than any of the commercially available pacifiers.

In addition to measuring the thumbs of numerous infants, molds were made of the thumb and palatal structure of a LBW infant, which revealed that the thumb fit into the palatal arch extremely well.

Figure 2:
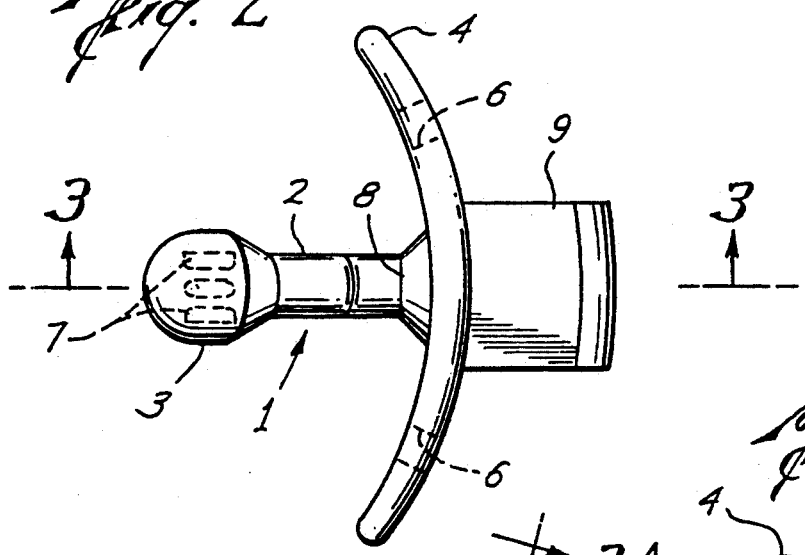
FIG. 2 is a plan view of a pacifier constructed in accordance with the preset invention.

FIG. 2 is a plan view of the preferred embodiment illustrating curved shield 4 and the shape of nipple 1. Shield portion 4 is configured to provide optimum perioral stimulation of the infant during use of the pacifier. In the embodiment illustrated, which is exemplary only and is not intended to limit the invention to the specific dimensions described, shaft portion 2 of the nipple is 6 mm in exterior diameter with a wall thickness of 1 mm. Ridges 7 are molded onto the interior surface of tip portion 3 to provide firmness for optimum palatal stimulation during use. Ridges 7 also provide a firm central core with a softer exterior, which simulates the thumb and human nipple. The desired firmness can be obtained by other methods as well, including but not limited to increasing the wall thickness or altering the material or material hardness chosen for tip portion 3.

Figure 3:
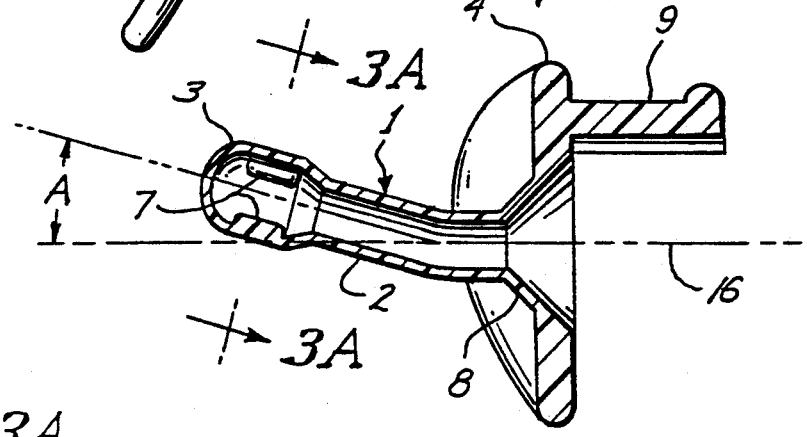
FIG. 3 is a cross-sectional view through section 3—3 of FIG. 2.
Figure 3A:
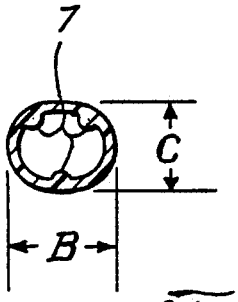
FIG. 3A is a cross-sectional view of the tip portion of the invention through section 3A—3A of FIG. 3.

FIG. 3 is a cross-sectional view of the invention, through section 3—3 of FIG. 2, showing nipple 1 and shield 4 of unitary construction. FIG. 3A, a cross-sectional view across tip portion 3 through section 3A—3A, shows that tip portion 3 is elliptical in shape and in this embodiment is approximately 10 mm wide in exterior major diameter B and approximately 8 mm wide in exterior minor diameter C. The ratio of the major diameter to the minor diameter is preferably between 1.0 and 1.5. Tip portion 3 has a circumference at its widest point of between 18 and 35 mm, in particular approximately 27 mm, which approximates the circumference of a LBW infant's thumb. Stiffening ridges 7 on the interior of tip portion 3 are also shown in FIGS. 3 and 3A.

Referring to FIG. 3, nipple 1 of this embodiment is angled upward (Angle A) from perpendicular to shield 4 at, for example, 6 between 10 and 20 degrees, in particular about 15 degrees, to allow tip portion 3 to attain the proper position in the palatal arch when shield 4 is positioned against the perioral region of the infant's face. The overall length of nipple 1 is preferably between 20 mm and 32 mm, and is selected to replicate the length of a LBW infant's thumb, and to properly place tip portion 3 in the palatal arch. Tip portion 3 constitutes 35 to 55 percent of the overall length of the nipple.

The subsection of shaft portion 2 which extends orthogonally from the shield in the illustrated embodiment is referred to as connecting portion 8, which constitutes means for connecting the shaft portion 2 to a shield or to any other nipple utilizing device, for example, an adapter to connect the nipple to a feeding tube or bottle. Alternatively, a pacifier could be constructed in accordance with this invention by directly connecting a straight shaft at a non-orthogonal angle to the shield, without a distinct connecting portion.

Nipple 1 of this invention may be solid or hollow, or it may be filled with an appropriate liquid or gelatinous material. Alternatively, shaft portion 2 may be hollow and only tip portion 3 made solid or filled with a suitable material.

The shield is irregular in shape with an area that anatomically fits under the nose. The width of the shield from top to bottom at the centerline is approximately 30 mm, which reflects the mean obtained (30.7 mm) when measuring the distance from chin to nose on LBW infants. The width of this shield from side to side is approximately 45 mm, which is smaller than the corresponding dimension of commercially available pacifiers and is intended to prevent displacement of the pacifier when the infant's head is in the side lying position.

The preferred embodiment illustrated in FIGS. 1, 2 and 3 is equipped with handle 9 affixed to shield portion 4, which handle can be manually grasped or mechanically clamped to facilitate use of this invention. The handle 9 also acts to provide the infant with a device to hold while sucking, and it is a safety device which can be grasped if the pacifier is aspirated. The material selected for the shield portion is preferably soft enough to be readily modified if required to accommodate, for example, placement of tubes.

Alternatively, a nipple according to this invention may be utilized in conjunction with any nipple utilizing device, such as, for example, with a shield to constitute a pacifier, or with a bottle used to feed an infant.

Figure 4A:
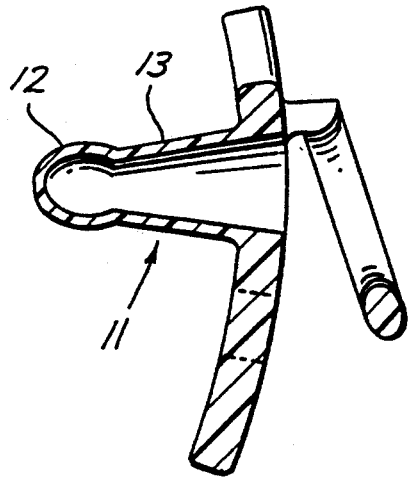
Fig. 4A PRIOR ART
FIGS. 4A, 4B, and 4C are cross-sectional views from the side of prior pacifiers designed and advertised for use with premature infants.
Figure 4B:
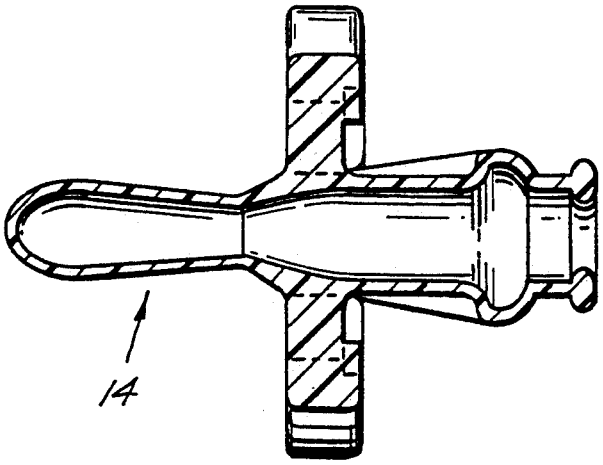
Fig. 4B PRIOR ART
Figure 4C:
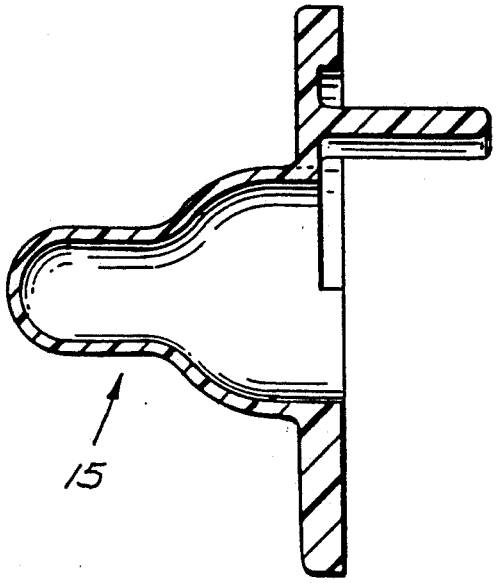
Fig. 4C PRIOR ART

FIGS. 4A, 4B, and 4C are cross-sectional views of prior art pacifiers which are advertised for use by premature and newborn infants. These figures are drawn to the same scale as is FIG. 3, and serve to illustrate the distinctly different size and shape of the current invention as compared to the prior art.

FIG. 4A is a pacifier which is manufactured by DHD Medical Products as Part No. 55-2100 and is marked patent pending. This pacifier has a nipple 11 which will fit into an infant's mouth with a significantly different configuration than will the nipple of the present invention. In particular, tip portion 12 will not attain the correspondence with the palatal arch during use as does tip portion 3 of the nipple according to the present invention. In addition, experience with the nipple of FIG. 4A has revealed that it has a tendency to come out of the infant's mouth due to the generally conical shape of shaft portion 13 and its lack of any structure which can be gripped by an infant's lips and gums.

FIG. 4B is a pacifier which is distributed by Binky-Griptight, Inc. as No. 3031, and is sold in a package marked "especially for premature infants." This pacifier has nipple 14 of a broad and flattened bulbous shape that is notably different in size and shape from nipple 1 of the present invention. It has no distinct tip and shaft portions, and it does not place a thumb substitute into the palatal arch as does the present invention.

FIG. 4C is yet another prior art pacifier designed and marketed for premature infants. This pacifier is distributed by Ross Laboratories as the "Ross Premie Soother Neonatal Pacifier." Nipple 15 of this pacifier will clearly assume a quite different position in an infant's mouth than will nipple 1 of the present invention.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size, and arrangement of parts. For example, equivalent elements or materials may be substituted for those illustrated and described herein, and certain features of the invention may be utilized independently of the use of other features, all as would be apparent to one skilled in the art after having the benefit of this description of the invention.

What is claimed is:

1. A pacifier comprising:

a nipple including a tip portion coupled to a first end of a shaft portion and constructed of a soft and flexible material, the shaft portion having a relatively constant diameter;

a shield portion connected to a second end of the shaft portion, the shield portion shaped to contact and stimulate an individual's perioral region when the nipple is placed in an individual's mouth;

at least one part of the shaft portion being angled from the perpendicular to the shield portion and a second part of the shaft portion being angled with respect to said one part, the shaft portion being adapted to place the tip portion of the nipple in a palatal arch of an individual when the nipple is placed in an individual's mouth with the shield portion in contact with the individual's perioral region.

2. The pacifier of claim 1, wherein the nipple and shield portion are integrally molded to form a one-piece pacifier.

3. A pacifier for soothing a low-birth-weight infant, comprising:

a nipple, including a shaft portion and a tip portion, constructed of soft and flexible material;

said tip portion being connected to a first end of the shaft portion and being bulbous and substantially larger in circumference than the shaft portion;

a shield connected to a second end of the shaft portion; and at least one part of the shaft portion angled upward toward the palatal arch from perpendicular to the shield, while a second part of the shaft portion is angled with respect to said one part, whereby the shaft portion is adapted to place the tip portion into the palatal arch of a low-birth-weight infant when the nipple is placed into the infant's mouth with the shield in contact with the infant's perioral region.

4. The pacifier of claim 3, wherein the tip portion is less than 35 mm in circumference at its largest point and the nipple extends at least 20 mm from the shield.

5. A pacifier according to claim 3, wherein said one part of the shaft portion is angled upward toward the palatal arch from perpendicular to the shield by an angle of at least 10 degrees.

* * * * *